US007843321B2

(12) United States Patent
Marchasin et al.

(10) Patent No.: US 7,843,321 B2
(45) Date of Patent: Nov. 30, 2010

(54) VEHICLE VIOLATION ENFORCEMENT SYSTEM AND METHOD

(75) Inventors: Cory D. Marchasin, Lambertville, NJ (US); Bartholomew S. Blair, Bridgewater, NJ (US); Chad Collins, Southampton, PA (US); Patrick Moynihan, Bedminister, NJ (US)

(73) Assignee: IPT, LLC, Somerville, NJ (US)

( * ) Notice: Subject to any disclaimer, the term of this patent is extended or adjusted under 35 U.S.C. 154(b) by 311 days.

(21) Appl. No.: 12/031,569

(22) Filed: Feb. 14, 2008

(65) Prior Publication Data

US 2008/0238719 A1 Oct. 2, 2008

Related U.S. Application Data

(60) Provisional application No. 60/889,965, filed on Feb. 15, 2007.

(51) Int. Cl.
*G08B 26/00* (2006.01)

(52) U.S. Cl. ..... 340/505; 705/13

(58) Field of Classification Search ..... 340/505, 340/932.2; 705/13

See application file for complete search history.

(56) References Cited

U.S. PATENT DOCUMENTS

| | | | |
|---|---|---|---|
| 2003/0062998 | A1 | 4/2003 | Rubenstein |
| 2005/0068196 | A1 | 3/2005 | Marin |
| 2006/0214783 | A1 | 9/2006 | Ratnakar |

*Primary Examiner*—John A Tweel, Jr.
(74) *Attorney, Agent, or Firm*—Sills Cummis & Gross P.C.

(57) ABSTRACT

A vehicle violation enforcement and noticing system that includes a first server and a second server. The first server contains a vehicle information database that is in communication with the second server. The second server is a mobile data terminal that allows for the identification of vehicles and retrieves the vehicle information pertaining to the identified vehicles from the first server via a communications link. Once the vehicle information has been received, appropriate enforcement tactics are prepared based upon the received vehicle information. The appropriate enforcement tactics may include printing a notice informing a vehicle user of the current and outstanding debt associated with the vehicle for placement directly on the vehicle, writing a notice as per instructions displayed by the second server, for placement directly on the vehicle, booting the vehicle, towing the vehicle and/or informing a second agency of the vehicle location so that the second agency may take appropriate action.

30 Claims, 2 Drawing Sheets

VEHICLE VIOLATION ENFORCEMENT SYSTEM AND METHOD

CROSS REFERENCE TO RELATED APPLICATION

The present application claims benefit of provisional application No. 60/889,965, filed Feb. 15, 2007.

FIELD OF THE INVENTION

This invention relates to a system and method for enforcing vehicular violations and collecting outstanding debts.

BACKGROUND

Vehicular parking laws are usually enforced by issuing a summons and placing the summons on the vehicle. Typically, the owner of the vehicle reviews the summons and is then required to inquire as to the fine, pay the fine and/or appear in court to contest the summons. The enforcement of the payment of the fines is haphazard in that in many instances the vehicle owner either does not pay the fine within a reasonable timeframe mandated by a municipal ordinance or statute, (e.g., such as 24 hours or 2 weeks from the date of ticket issuance) or does not pay the fine at all.

The fines and penalties assessed often increase substantially for repeat violators who are termed scofflaws—people who ignore such summons. The unpaid tickets from these motorists, regardless of their legal scofflaw status, prompts a shift of effort and resources because their status requires the municipality to adjust from a mode of enforcement of parking rules to one of collection of unpaid debts often using a conventional vehicular related debt collection program.

Further, conventional vehicular-related debt collection programs, such as collection procedures used for parking tickets, or automotive personal property taxes, generally use notices mailed through the general post to deliver either official notice of a debt as part of an adjudication or court summons process, or as a general notification of outstanding debt in order to prompt payment. These notices are usually printed, mailed, handled and tracked by a different department, and/or personnel than those involved in the enforcement effort, making it difficult to track the efficacy of either party's work and the subsequent positive effects on the other (such as a mailed notice campaign's effect on parking compliance, windshield payment rates, or overall delinquencies).

Furthermore, these traditional mailed notices are limited in their ability to succeed by the inconsistency of up-to-date physical address information at the data source, which in most cases, is the entity responsible for the registration of the vehicle, such as a Department of Motor Vehicles. This is especially true in the case of inter-state collections where an out-of-state motor vehicle registration entity is required to be queried in order to get a physical address for which to deliver notice. A lack of inter-state communication in regards to municipal debt has led to an absence of reciprocity in the collection efforts and although interstate registration information is often available to a municipal collection program it often requires third party or private contractors to facilitate the exchange of data between states and/or limits any actual legal action beyond official notification because of the lack of reciprocity (e.g. license registration, suspicion/revocation points on license, etc., all of which are often-used tools for in-state collections). In the absence of consistently correct and functionally attainable vehicle registrant addresses for mailing a notice to, the target of the notice is for all intents and purposes, unreachable; thereby causing this costly traditional collection process to fail in many cases.

One solution to insure payment of fines is to place a "boot" on a vehicle's wheel. Such a boot is a device that is attached to the vehicle wheel to render operation of the vehicle impossible since the wheel is no longer able to roll due to the presence of the boot. Such boots are commonly used and widely available, but are typically cumbersome and heavy, and may be an extreme measure for an offender who only has one or two outstanding violations, or where an offender has violations that he/she is not aware of. Thus, the alleged violator may not know of any outstanding violations and be subject to a boot placed on his/her vehicle, causing severe inconveniences.

Furthermore, in some municipalities, legislation has been enacted by ordinance, or through formal or informal policy, to require successful mailed notification to any vehicle registrant of their scofflaw status before an immobilization or towing action can be taken with regard to a particular vehicle. A "Catch-22" situation is thus created in instances where a physical address cannot be ascertained by the parties responsible for collection, despite that the registrants' vehicle is accessible, potentially on a daily basis, by those parties responsible for enforcement, and whereas this same vehicle may continue to collect parking citations despite both the motorists unwillingness to pay them, and the municipalities ability to prompt payment through legal action.

Accordingly, there is a need in the industry for a method and system for ensuring that a person with currently unpaid or outstanding vehicle parking violation debts to receive adequate notice that there are violation fees or fines that are due or past due, before other extreme measures are taken, such as placing a boot on the vehicle, towing/impounding and/or revocation of the person's license while retaining the ability to track the successful delivery of such notices to vehicle registrants with more confidence than provided by the sending of a registered letter through the post office.

SUMMARY OF THE INVENTION

The present invention allows a vehicular related debt collection program to increase its effective collections despite the absence of limited or correct vehicle registration data by providing a more successful means of locating, noticing, tracking and/or managing the collection status of previously reachable, unreachable and/or "un-noticeable" debtors by establishing and interrogating, either on-foot or via an enforcement vehicle, a unique identification source of a vehicle. This may be accomplished without shifting the source of the vehicle registrant notification work effort to a separate department/group of personnel/resources and substantially minimizing work flow/load for each enforcement shift.

ID sources used in the present invention include but are not limited to license plate identification via mobile license plate recognition systems, vehicle identification numbers (VIN), vehicle registrations, radio frequency identification (RFID), or other types of electromagnetic spectrum broadcasts which can be referenced to a database of relevant debtor information associated with that vehicle in real time, and which allows an enforcement officer or noticing agent to affix a notice to a window of the discovered vehicle.

In one embodiment, a mobile data terminal for vehicle violation enforcement and noticing comprises an identification device, a transmitter-receiver, an electronic memory and an enforcement module. The identification device identifies unique identification numbers for particular vehicles. The identification device may be a license plate recognition device or a radio frequency identification tag that includes a RF transmitter, an RF receiver, an RF modulator, memory for storing identification/enforcement data and an optional GPS system.

The mobile data terminal sends these unique identification numbers (e.g. license plate numbers, vehicle identification numbers, vehicle registrations, driver information, insurance information, etc.) to a remote storage medium through the use of the transmitter-receiver which may be part of a wireless communication system. The remote storage medium includes a vehicle information database that contains information pertaining to vehicles with current and outstanding debt associated with the vehicle and associated unique vehicle identification numbers.

Once the information is transmitted to the remote storage medium, the transmitter-receiver retrieves vehicle information associated with the unique identification number from the remote storage medium. The electronic memory then stores the information retrieved from the remote storage medium on the mobile data terminal. Based on the retrieved data, enforcement tactics are then prepared by the enforcement module. The appropriate enforcement tactics may include, but are not limited to, (1) printing a notice informing a vehicle user of the current and outstanding debt associated with the vehicle, (2) writing a notice as per instructions received from the remote storage medium and/or mobile data terminal, (3) booting the vehicle, (4) towing the vehicle and (5) informing a second agency of the vehicle location so that the second agency may take appropriate action.

The mobile data terminal may also include at least one input device. The input device(s) allow for the input of violation information (information pertaining to a particular vehicle, current violations for the particular vehicle and vehicle-specific data, such as, vehicle identification information and vehicle location) onto the electronic memory and/or the storage medium. The input device(s) may be a keyboard, a camera or stored information received from an external memory.

The vehicle violation enforcement and noticing system of the present invention includes at least one storage medium, a mobile data terminal and a communication link. The storage medium contains a vehicle information database that stores information pertaining to vehicles with current and outstanding debt associated with the vehicle and unique vehicle identification numbers. The unique vehicle identification numbers may include license plate numbers, vehicle identification numbers, vehicle registrations, driver information and insurance information.

The mobile data terminal uses the communication link to communicate with the storage medium. This communication link may be a wireless communication system.

The mobile data terminal is also in communication with identification device that allows for identification of a vehicle through the use of unique vehicle identification numbers. The identification device may be a license plate recognition device or a radio frequency identification (RFID) tag. If the RFID tag is used, the RFID tag may include a RF transmitter, an RF receiver, an RF modulator, memory for storing identification and enforcement data and an optional GPS system.

The recording medium uses the information collected by the identification device to retrieve vehicle information pertaining to the identified vehicles from the vehicle information database stored on the recording medium via the communication link.

Once the mobile data terminal receives the retrieved information, the mobile data terminal allows for the preparation of appropriate enforcement tactics based upon the retrieved vehicle information. The appropriate enforcement tactics may include (1) printing a notice informing a vehicle user of the current and outstanding debt associated with the vehicle, (2) writing a notice as per instructions displayed by the second server, (3) booting the vehicle, (4) towing the vehicle and/or (5) informing a second agency of the vehicle location so that the second agency may take appropriate action.

After the appropriate action has taken place, an input device may be used to input violation information onto the first server via the second server. The violation information may include information pertaining to a particular vehicle, current violations for the particular vehicle and vehicle-specific data, such as, vehicle identification information and vehicle location. The inputting may be performed by a keyboard, a camera or stored information received from the RFID tag.

In order to use the vehicle violation enforcement and noticing system, a user must first identify a particular vehicle using an identification device that is in communication with a mobile data terminal. The identification may be performed by a license plate recognition device and/or a radio frequency identification (RFID) tag.

Once a vehicle has been identified, the identification information is sent to a remote server via a communications network where the identification information retrieves vehicle information pertaining to the particular vehicle from a vehicle information database stored on the remote server. The vehicle information database contains information pertaining to vehicles with current and outstanding debt associated with the vehicle and unique vehicle identification numbers. The unique vehicle identification numbers includes at least one of license plate numbers, vehicle identification numbers, vehicle registrations, driver information and insurance information.

Once retrieved, the vehicle information is sent to the mobile device where appropriate enforcement tactics based upon the vehicle information are prepared. The appropriate enforcement tactics may include (1) printing a notice informing a vehicle user of the current and outstanding debt associated with the vehicle, (2) writing a notice as per instructions displayed by the second server, (3) booting the vehicle, (4) towing the vehicle and (5) informing a second agency of the vehicle location so that the second agency may take appropriate action.

After the appropriate action is taken, the current violation information may be inputted onto the mobile device and then transmitted to the remote server. The current violation information may include information pertaining to the particular vehicle, current violations for the particular vehicle and other vehicle-specific data, such as, vehicle identification information and vehicle location. This inputting may be performed by a keyboard, a camera or stored information received from the RFID tag.

DETAILED DESCRIPTION OF THE INVENTION

Although this invention is applicable to numerous and various types of debt collection methods, it has been found particularly useful in the environment of vehicle violations and debt collection. Therefore, without limiting the applicability of the invention to the above, the invention will be described in such environment.

Figure 1:
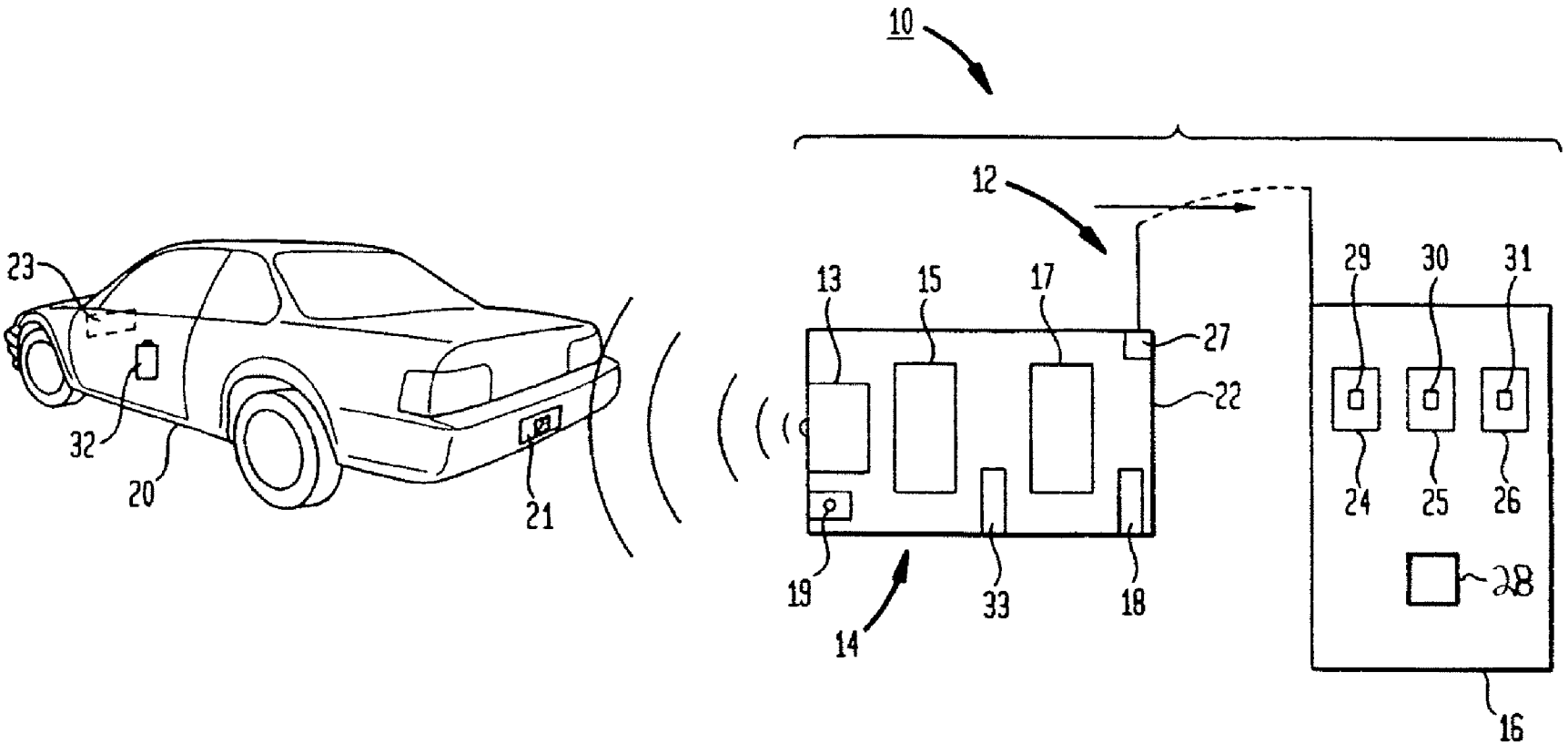
FIG. 1 shows a vehicle violation enforcement and noticing system according to a first embodiment of the present invention.

In the first embodiment of the present invention, as shown in FIG. 1, a vehicle violation enforcement and noticing system 10 includes a server-side 16, a client-side 14 and a communications link 12.

The server-side 16 includes servers 24-26 that may contain a central processing unit (CPU) 28 and multiple server-side databases being stored on storage mediums 29-31. The databases may contain information relating to vehicles with current and outstanding debt associated with the vehicle, e.g., traffic and parking violations, moving violations, outstanding ticket fines, scofflaw status, etc. The information further may contain certain vehicle information, such as, unique identification numbers, e.g., license plate numbers, vehicle identification numbers, registrations, driver information, insurance information, etc.

The server-side database may also include scofflaw data. Scofflaw data refers to the scofflaw status of a vehicle and the scofflaw database contains files on each scofflaw and associates the scofflaw with known identification numbers such as a license plate number or VINs. (A scofflaw is a person whose vehicle has reached a numerical or financial sum threshold for unpaid parking violations. The threshold of outstanding violations to achieve scofflaw status may vary for summons-issuing governing bodies such as for example, a municipality, a city, a university or a corporation. For example, a scofflaw may have two or more outstanding violations more than 30 days overdue, or in another municipality the threshold may be more than $100.00 worth of parking citations that are more than 15 days overdue (whereas the $100.00 might represent four $25.00 citations or a single citation of $100.00)).

The server-side 16 is capable of transmitting and receiving the information stored on the recording mediums 29-31 to the client-side 14 via transmitter-receiver which is part of a communications link or network 12. The communications network 12 may be any wireless system found in the prior art that allows data communication between two or more servers.

In the first preferred embodiment, the client-side 14 is a Mobile Data Terminal (MDT) 22 that may be carried by a user. The MDT 22 may include an identification device 13, e.g. an Optical Character Recognition (OCR) device, a client-side database being stored on a recording medium 18, a display 15, a keyboard 17, a camera 19 and combinations thereof.

The OCR device 13 is a device that uses OCR technology to decipher a license plate 21 without the need for user input. For background, OCR technology is a well-established technology that has many applications in the publishing and archiving industry. Essentially, OCR is an image analysis process that converts a raster-scanned image of printed characters into machine-readable ASCII codes, thereby eliminating the need to re-type old documents into a computer and rendering them amenable to automated processing.

In the present invention, the OCR technology is used to digitize a vehicle's license plate number from its raster-scanned image. When applied to vehicular imagery, OCR technology is commonly referred to as "License Plate Recognition" (LPR). LPR has been applied to stationary law enforcement and security applications (e.g. identifying vehicles in controlled areas such as parking garages). LPR technology has also been successfully applied in revenue collection applications (e.g. automatic billing of motorists using toll highways), and for enforcement of parking fines (e.g. a fine for parking in an area past the time allowed).

LPR is a complex process that is documented in the literature and prior art. Various aspects of LPR methodology and terminology are used in the present invention and will only be briefly described. Essentially, LPR is comprised of three operations that are sequentially applied to the vehicle's raster-scanned image. These processes attempt to progressively refine the complex, unique identification of the vehicle captured by the raster-scanned image into an alphanumeric string of text identical to the text inscribed on the vehicle's license plate. Since this alphanumeric string of test is compact, easily comprehended and legally linked to the vehicle's owner, its correct extraction from the raster-scanned image is the ultimate goal of LPR. The interim digital encapsulations of the raster-scanned image that are part of the LPR process are less desirable; however, they also uniquely identify the vehicle in a way that has been exploited in certain LPR applications. The interim encapsulations of LPR are analogous to a person's fingerprint while the end product of LPR (the license plate number) is analogous to the same person's name.

The three conceptual steps that comprise LPR are: vectorizing the raster-scanned image (i.e., creating a "vector-model"), recognizing the license plate within the vector-model (isolating only those vectors that describe the license plate within the vector-model), and recognizing the alphanumeric characters in the plate-model (such as by full recognition mode LPR or pattern-matching LPR). Methods of the actual LPR are known in the art and any technique for LPR can be used in the present invention, and are not limited to any type of specific LPR. Such LPR technology is discussed in U.S. Pat. No. RE 38,626, the entirety of which is incorporated herein by reference, with regard to enforcing parking regulations.

Another feature that may be found on the MDT 22 is a client-side database. The client-side database may be stored on electronic memory, such as, an internal, external or removable memory card 18 and is associated with a reader/writer device. These memory cards 18 are widely available and sometimes are referred to as compact flash memory cards or secure data (SD) cards. The cards are relatively small and have a large memory, e.g., 16, 64, 128 or 256 megabytes memory capacity. Examples of these cards are cards commonly used with digital cameras and other electronic systems.

The MDT 22 may retrieve and/or receive information from the server-side database and/or other devices that are connected to the client-side server 14, e.g., an input device such as keyboards 17, cameras 19, touch screen displays 15 and other input devices. The input devices allow a user to enter information about vehicles that have been successfully served notices and provide the ability to track status and number of notices served upon a particular vehicle (including date, time, physical address and/or global positioning system (GPS) coordinates of vehicle when the notice was affixed, and notice type). Further, the vehicle location may be selected from codes for cities, municipalities, etc. stored on the MDT 22.

Other data that may be entered by the input device includes the name of the summons issuing person or municipal officer (which may be entered by a scanner 27 from an officer ID card in some instances when available), the date, time and location of the summons, the summons number, the violation code and scofflaw indicator which indicates the violator is a scofflaw.

The camera 19 may also be utilized so that photographs of the violation vehicle 20 with the notice 32 affixed to the vehicle may be taken. This ensures that there is digital evidence of the service of the notice 32.

In use, when an enforcement officer is patrolling in a given area, the officer may use the camera 19 and take a picture of a vehicle's license plate 21, VIN 23 or any other readable identification number (the identification numbers may also be manually input into the device).

If a camera 19 is used, the image taken by the officer is then sent from the camera to OCR software located on the client-side server 14. The image is then transformed into a computer readable license plate number or VIN, as described above.

The identification number is then sent to the server side 16 and is cross-referenced with the server-side database so as to retrieve information regarding the vehicle 20. If any information is found, the data is transmitted back to the client-side server 14 and may be displayed on the display device 15 and/or stored in the memory 18. The enforcement officer then determines through the received information if there are outstanding violations associated with the vehicle 20 and its current scofflaw status.

If the vehicle 20 has such violations, the MDT 22 allows the officer to print via an attached printer 33 a notice 32. This notice 32 may then be attached to the vehicle 20. The notice 32 may have information common to mailed notices, such as violation and/or debt information, ticket information (amount and ticket numbers, etc.), legal information, general collection disclosures (such as legal actions pending against vehicle registrant), instructions to remedy, next required steps, payments information, instructions to call/email/go to a web site and/or a physical address to visit for reconciliation. The officer may also take a picture of the vehicle 20 with the notice 32 attached for digital evidence of service.

The LPR technology may also provide the GPS coordinates of the vehicle 20 which can be recorded by the software of the present invention and stored on the server-side database 18. The officer can also manually record the physical street address of the vehicle, which is also recorded and stored by the software of the present invention.

If the vehicle 20 is moved from the location where it received the notice 32 and/or the driver does not make the payment, the next time the enforcement officer comes across the vehicle, and the license plate 21 is scanned using the LPR technology, the software recalls whether a notice 32 has been previously applied to the vehicle 20, the date/time it was applied and the location of the vehicle. The software of the present invention can then inform the enforcement officer what the next appropriate step is. This can be determined by the law of the municipality or city. Actions that may be taken are: applying a second notice, giving another fine, applying a boot and/or towing/impounding the vehicle. (The term "municipality" as used herein is intended to represent any controlling governing body that issues summons for parking violations and may include private parties as well as political entities.)

The software of the present invention can also record what law or policy is applicable and inform the officer of the next step so the officer can take the appropriate action as required. All this information can be communicated into the software and recorded through a wireless system 12.

Figure 2:
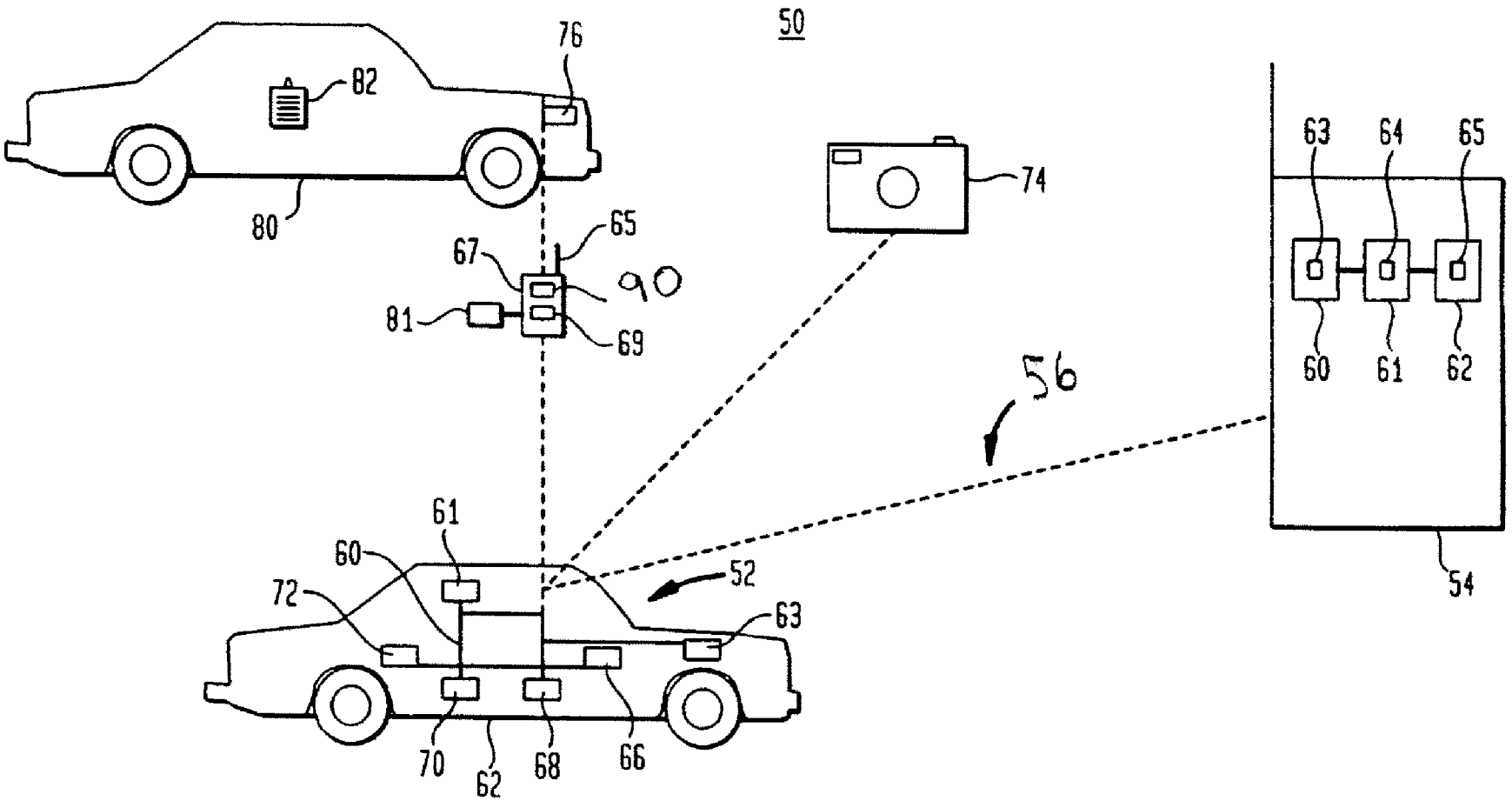
FIG. 2 shows a vehicle violation enforcement and noticing system according to a second embodiment of the present invention.

As shown in FIG. 2, a vehicle violation enforcement and noticing system 50 includes a server-side 54, a client-side 52 and a communications link 56.

The server-side 54 includes servers 60-62 that may contain a central processing unit (CPU) 63 and multiple server-side databases being stored on storage mediums 63-65. The databases may contain information of vehicles with current and outstanding debt associated with the vehicle, such as traffic and parking violations, moving violations, outstanding ticket fines, scofflaw status, etc. This information further may contain certain vehicle information, such as unique identification numbers, including license plate numbers, vehicle identification numbers, registrations, driver information, insurance information, etc.

The server-side 54 is capable of transmitting and receiving information from the client side 52 via a communications link or network 56. The communications network 56 is any wireless system that may be found in the prior art and allows two servers to communicate with each other.

In the second preferred embodiment, the client-side 52 is a Mobile Data Terminal (MDT) 60 that is mounted in an enforcement vehicle 62. The mounted MDT 60 may include an RFID (radio frequency identification) reader/writer 90, a client-side database stored on memory 68, a display 66, a keyboard 70, a camera 74 and combinations thereof.

In the present invention, the RFID reader/writer 90 is used to receive digital information from an RFID tag 76. The RFID reader/writer 90 is a device that can be used remotely from the mounted MDT 60 and is in wireless communication with the MDT 60 or, in the alternative, may be hardwired to the MDT 60.

RFID tags 76 are commercially available prior art electronic tagging devices. This device 76 is known to be programmable and capable of transmitting programmed information. The programmed information may be a tag identification number unique to each tag or other information as desirable for a given implementation.

Generally, an RFID tag 76 includes a radio frequency (RF) transmitter/receiver 65, an RF modulator 67, and a memory 69. The memory 69 retains a digital code manifesting the identification number of the tag that is unique to each tag 76. The RF modulator 67 extracts the digital code representing the identification number and other information as stored in the memory 69 as a modulated signal which is applied to the RF transmitter/receiver 65. The RF transmitter/receiver 65 receives interrogation and control signals which manifest a request for the identification number and other information as may be stored in the memory 69. The RFID reader/writer 90 or interrogator unit transmits an interrogation signal to the tag 76 to retrieve information stored in the tag 76. The interrogation unit may also transmit information to be stored in the tag 76 and which can be retrieved by the interrogator unit at a later date.

The RFID tag 76 having a unique ID can be attached to the vehicle 80 or already on the vehicle 80, such as on the registration sticker, license plate, or windshield.

A handheld or mounted RFID reader/transmitter 90 with or without display is used by the enforcement officer. The RFID reader/transmitter 90 is for entering, receiving, storing and transmitting second information at least to and from the tag 76 including the tag ID, violation data of the parking violation, the violations and debts listed in the notice and when/where the notice 82 was affixed to the car 80.

Another feature that may be found on the MDT 60 is a client-side database. The client-side database may be stored on an internal, external or removable memory card 68 and is associated with a reader/writer device. These memory cards 68 are widely available and sometimes are referred to as compact flash memory cards or secure data (SD) cards. The cards are relatively small and have a large memory, e.g., 16, 64, 128 or 256 megabytes memory capacity. Examples of these cards are memory cards used with digital cameras and other electronic systems.

The MDT 60 may receive information from the server-side database 54 and/or other devices that are connected to the client-side server, e.g., an input device, e.g. keyboards 70, cameras 74, touch screen displays 66 and other input devices.

The input devices may be hardwired to the mounted MDT 60 or may be in wireless communication with the mounted MDT 60.

The input devices allow a user to enter information about vehicles that have been successfully served notices and provides the ability to track status, number of notices delivered (including date, time, physical address and/or global positioning system (GPS) coordinates of vehicle when the notice was affixed, and notice type).

Other data that may be entered by the input device includes the name of the summons issuing person or municipal officer (which may be entered by a scanner 61 from an officer ID card in some instances when available), the date, time and location of the summons, the summons number, the violation code and scofflaw indicator which indicates the violator is a scofflaw.

The camera 74 may also be utilized so that photographs of the violation vehicle 80 with the notice 82 affixed to the vehicle 80 may be taken. This ensures that there is digital evidence of the service of the notice 82.

In use, the enforcement officer communicates with the RFID tag 76 via the RFID reader/transmitter 90. The RFID tag 76 information is uploaded onto the RFID reader/transmitter 90 and then uploaded onto the mounted MDT 60. The officer may then read the uploaded information on either the display 81 located on the RFID reader/transmitter 90 or the display 66 connected to the MDT 60. The information may contain violation data that includes but not limited to the RFID unique code, the date and time of violation, the scofflaw information manifesting if the violator is a scofflaw and to optionally include the total fines attributed to the outstanding violations, the vehicle make, the vehicle license number, state of registration, the summons number and the violation code.

If the information uploaded contains the current and previous violations the officer may take appropriate enforcement action. If there is no additional information on the RFID tag 76, the RFID ID number may be transmitted to the server-side 54 for retrieval of the vehicle information. The violation data can be uploaded via the network 56 or, by telephone if the MDT 60 does not have a modem or communication device for communicating with the network 56.

If the RFID tag 76 matches a vehicle in the database, the enforcement officer can proceed to print out a notice 82 having information as to the type of notice and legal language required to be entered on the notice 82. The notice 82 can include a list of all outstanding violations, ticket numbers, associated debt and/or fines, fees, type of ticket/violation, dates, time, etc. The notice 82 can also include information on how to proceed to pay the fines, such as a telephone number, address for payment, a web site for payment, etc. The enforcement officer can either print (with a portable in-vehicle printer 63) a notice 82 or write up a notice 82 as per the client software system instructions.

The notice 82 can be affixed to the vehicle 80 by any of a variety of attachment means known in the art, such as by tape, glue, etc. A picture can also be taken of the vehicle to have evidence of service. Once appropriate enforcement action takes place, the RFID tag 76 and the server-side database 63-65 is updated with the current status of the vehicle 80.

When the driver returns to the vehicle 80, the driver will see a notice 82 affixed to his vehicle 80. The notice 82 informs the driver of the information printed on the notice 82 and how much the outstanding fines are. The notice 82 may also inform the driver that if the fines have not been paid by a certain date, the driver will be subject to towing/impounding, a boot placed on the vehicle, and/or legal action. The driver can decide to immediately make the payments or make the payments at a later time via the payment instructions provided on the notice.

If the vehicle is moved from the location where it received the notice, the RFID tag 76, if used, can also provide notice that the vehicle has been moved, and its location via GPS technology. If the vehicle moves, the enforcement officer and the corresponding municipality can be certain that the person has received the notice of his outstanding violations. If the driver refuses to pay and does not make any payments within a time limit set out in the notice or other time limit, the vehicle 80 can then be tracked or scanned, and when found, a boot can be placed on the vehicle, or the vehicle can be towed/impounded.

The enforcement officer or server system can also send an impound/tow/boot notice to the municipality that issued the outstanding violations. The municipality can then contact a towing/booting for towing/booting the violation vehicle.

The present invention allows the client-side software running in the enforcement officer's vehicle to upload information gathered about vehicles successfully noticed, thereby allowing administrators of the noticing or collections program to successfully track noticed vehicles for the purposes of legal escalation or continued adjudication or other historical compilation. If the vehicle 80 is moved from the location where the notice was applied, it can be tracked using mobile LPR or RFID data and verified that the vehicle 80 has moved and that the notice 82 was received by the motorist and the motorist has/has not paid the fines yet. The next time the vehicle is found, further steps can be taken, such as placing a vehicle wheel boot on the vehicle, applying a second notice, issuing another fine and/or towing/impounding of the vehicle if some or all of the fine(s) have not yet been paid.

The present invention provides a more effective means of notification delivery when debtor information is limited. Whereas traditional noticing systems rely upon complete and accurate physical address information, the present invention requires only the vehicle plate number, or VIN Number, or other unique number affixed to the vehicle or broadcast via RFID or other means of electromagnetic spectrum broadcast. A device using RFID is programmable and transmits information that is programmed, such as a tag identification number unique to each tag or other information as desirable for a given implementation.

While vehicle data can be entered manually, the MDT may also have software programming stored therein that enables the MDT to read the scofflaw database at the server-side system. The MDT can also have a connector for mating with a receptacle in which such data can be transferred using control circuitry at the client system, and transmit/receive this information to/from the server system.

It should be understood that the MDT may take many forms of electronic communication systems and may include personal computer systems (PC) such as laptops for example. Such laptops have appropriate software programs including RFID read/write capabilities. Access to the stored data may be made using Microsoft Access, or MsSQL, an open source server query language program based server-side database system that is commercially available form Microsoft Corporation and that is widely used, plain text files (.txt) or other database technologies. The plain text file is key for extracting data from multiple sources and for use with a universal readable format.

It will occur to one of ordinary skill that the disclosed embodiments are given by way of example, and that modifications may be made to the disclosed systems. For example, the MDT may include a digital camera whose data may also be communicated by the MDT to the RFID tag and to the client system and/or the server system. Different LPR technology can also be used in the present invention.

Other collections as well as vehicular-related debts and associated debts (public and private) such as parking tickets, moving violations, photo enforcement, EZ Pass or electronic toll violations, identifying unregistered vehicles, identifying uninsured vehicles, taxes, subpoenas, warrants, child support (which may require additional information) can also be collected by fixing such notices to the vehicles.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed:

1. A mobile data terminal for vehicle violation enforcement and noticing comprising:

an identification device, the identification device identifying a unique identification number for a particular vehicle;

a transmitter-receiver, the transmitter-receiver sending the unique identification number to a remote storage medium and the transmitter-receiver retrieving vehicle information associated with the unique identification number from the remote storage medium, the vehicle information including current and outstanding debt associated with the particular vehicle;

an electronic memory for storing the vehicle information retrieved from the remote storage medium; and an enforcement module for preparing a notice based upon the vehicle information retrieved from the remote storage medium, the notice including the amount of the current and outstanding debt associated with the particular vehicle and a warning that the particular vehicle will be subject to further enforcement action if the current and outstanding debt is not paid within a specified time frame.

2. The mobile data terminal of claim 1 wherein the remote storage medium includes a vehicle information database, the vehicle information database comprising information pertaining to vehicles with current and outstanding debt associated with the vehicle and associated unique vehicle identification numbers.

3. The mobile data terminal of claim 2 wherein the unique identification number includes at least one of license plate numbers, vehicle identification numbers, vehicle registrations, driver information and insurance information.

4. The mobile data terminal of claim 3 further comprising:

at least one input device, the input device allowing for the input of violation information onto the electronic memory and/or the storage medium, the violation information including information pertaining to a particular vehicle, current violations for the particular vehicle and vehicle-specific data.

5. The mobile data terminal of claim 4 wherein the at least one input device is at least one of a keyboard, a camera or stored information received from an external memory.

6. The mobile data terminal of claim 4 wherein the vehicle-specific data includes vehicle identification information and vehicle location.

7. The mobile data terminal of claim 1 wherein the transmitter-receiver is part of a wireless communication system.

8. The mobile data terminal of claim 1 wherein the identification device is a license plate recognition device.

9. The mobile data terminal of claim 1 wherein the identification device is a radio frequency identification tag, the tag comprises a RF transmitter, an RF receiver, an RF modulator, memory for storing identification and enforcement data and an optional GPS system.

10. The mobile data terminal of claim 1 wherein the further enforcement tactics comprise at least one of (1) printing a second notice informing a vehicle user of the current and outstanding debt associated with the vehicle, (2) writing a notice as per instructions received from the remote storage medium, (3) booting the vehicle, (4) towing the vehicle and (5) informing a second agency of the vehicle location so that the second agency may take appropriate action.

11. A vehicle violation enforcement and noticing system comprising:

a storage medium comprising a vehicle information database;

a mobile data terminal;

an identification device, the identification device identifying a unique identification number for a particular vehicle;

a communications link for allowing communication between the storage medium and the mobile data terminal, the communications link including a transmitter-receiver being located on the mobile data terminal, the transmitter-receiver sending the unique identification number to and retrieving vehicle information associated with the unique identification number from the vehicle information database, the vehicle information including current and outstanding debt associated with the particular vehicle; and an enforcement module for preparing a notice based upon the vehicle information retrieved from the vehicle information database, the notice including the amount of the current and outstanding debt associated with the particular vehicle and a warning that the particular vehicle will be subject to further enforcement action if the current and outstanding debt is not paid within a specified time frame.

12. The system of claim 11 wherein the vehicle information database comprises information pertaining to vehicles with current and outstanding debt associated with the vehicle and unique vehicle identification numbers.

13. The system of claim 12 wherein the unique vehicle identification numbers includes at least one of license plate numbers, vehicle identification numbers, vehicle registrations, driver information and insurance information.

14. The system of claim 11 wherein the communications link is a wireless communication system.

15. The system of claim 1 wherein the identification device is a license plate recognition device.

16. The system of claim 11 further comprising:

at least one input device, the input device inputting violation information onto the storage medium via the mobile data terminal, the violation information includes information pertaining to a particular vehicle, current violations for the particular vehicle and vehicle-specific data.

17. The system of claim 16 wherein the at least one input device is one of a keyboard, a camera or stored information received from an external memory.

18. The system of claim 16 wherein the vehicle-specific data includes vehicle identification information and vehicle location.

19. The system of claim 11 wherein the identification device is a radio frequency identification tag, the tag comprises a RF transmitter, an RF receiver, an RF modulator, memory for storing identification and enforcement data and an optional GPS system.

20. The system of claim 11 wherein the further enforcement tactics include at least one of (1) printing a second notice informing a vehicle user of the current and outstanding debt associated with the vehicle, (2) writing a notice as per instructions received from the storage medium, (3) booting the vehicle, (4) towing the vehicle and (5) informing a second agency of the vehicle location so that the second agency may take appropriate action.

21. A vehicle violation enforcement and noticing method comprising the steps of:

providing a vehicle information database stored on at least one storage medium;

identifying a particular vehicle using a mobile data terminal;

retrieving vehicle information pertaining to the particular vehicle from the vehicle information database via a communications network, the vehicle information including current and outstanding debt associated with the particular vehicle; and preparing a notice based upon the vehicle information retrieved from the vehicle information database, the notice including the amount of the current and outstanding debt associated with the particular vehicle and a warning that the particular vehicle will be subject to further enforcement action if the current and outstanding debt is not paid within a specified time frame.

22. The method of claim 21 wherein the vehicle information database comprises information pertaining to vehicles with current and outstanding debt associated with the vehicle and unique vehicle identification numbers.

23. The method of claim 22 wherein the unique vehicle identification numbers includes at least one of license plate numbers, vehicle identification numbers, vehicle registrations, driver information and insurance information.

24. The method of claim 21 wherein the communications network is a wireless communication system.

25. The method of claim 23 further comprising the step of:

inputting violation information onto the at least one storage medium via the mobile data terminal, the violation information including information pertaining to the particular vehicle, current violations for the particular vehicle and other vehicle-specific data.

26. The method of claim 25 wherein the step of inputting may be performed by a keyboard, a camera or stored information received from an external memory.

27. The method of claim 25 wherein the other vehicle-specific data includes vehicle identification information and vehicle location.

28. The method of claim 21 wherein the step of identifying may be performed by a license plate recognition device.

29. The method of claim 21 wherein the step of identifying may be performed by a radio frequency identification tag, the tag comprising a RF transmitter, an RF receiver, an RF modulator, memory for storing identification data and enforcement data and an optional GPS system.

30. The method of claim 27 wherein the further enforcement tactics include at least one of (1) printing a second notice informing a vehicle user of the current and outstanding debt associated with the vehicle, (2) writing a notice as per instructions displayed by the at least one storage medium, (3) booting the vehicle, (4) towing the vehicle and (5) informing a second agency of the vehicle location so that the second agency may take appropriate action.

* * * * *